United States Patent [19]

Gauthier

[11] Patent Number: 4,761,147

[45] Date of Patent: Aug. 2, 1988

[54] MULTIPIN CONNECTOR WITH FILTERING

[75] Inventor: Richard Gauthier, Morin Heights, Canada

[73] Assignee: I.G.G. Electronics Canada Inc., St. Laurent, Canada

[21] Appl. No.: 9,861

[22] Filed: Feb. 2, 1987

[51] Int. Cl.[4] ..... H01R 13/658

[52] U.S. Cl. ..... 439/607; 439/620

[58] Field of Search ..... 339/143 R, 147 R, 147 P; 333/181, 182, 183, 184; 439/607-610, 620-622

[56] References Cited

U.S. PATENT DOCUMENTS 3,002,162 9/1961 Garstang ..... 333/183
3,538,464 11/1970 Walsh ..... 333/182
4,371,226 2/1983 Brancaleone ..... 339/143 R

FOREIGN PATENT DOCUMENTS 2098412 11/1982 United Kingdom ..... 339/143 R

*Primary Examiner*—John McQuade
*Attorney, Agent, or Firm*—Fishman, Dionne & Cantor

[57] ABSTRACT

A ferrite plate is placed in the inner space formed by the front and rear shells of a multipin D connector. The ferrite plate is aligned with the insulator block in the inner space, and it has openings which are in alignment with the openings of the insulator block. Pins of the connector extend through the aligned openings of both the insulator block and the ferrite plate.

7 Claims, 3 Drawing Sheets

MULTIPIN CONNECTOR WITH FILTERING

BACKGROUND OF THE INVENTION

1. Field of the Invention

The invention relates to multipin connectors including filtering means. More specifically, the invention relates to such connectors wherein the filtering means comprise a ferrite material.

2. Description of Prior Art

Electronic devices which use high frequency pulse trains, such as computers, can generate signals which will cause radio frequency interference (RFI) and electromagnetic interference (EMI) to nearby radio and other electronic devices. The signals leak out through interconnecting, multipin connectors referred to as D connectors. Interference signals can also leak into the electronic devices through the same connectors.

Attempts have been made to include filtering means on the connectors to filter the EMI and RFI signals to ground, or to attenuate them so that they are no longer of significant amplitude. The connectors include openings through which the pins of the D connectors extend, and one of the filtering means consists of capacitors connected between openings to provide a high impedance path for the high frequency signals. Another approach is to have a small bead of ferrite material surround a portion of each pin. The ferrite bead is then covered with a thin layer of conductive material (silver) to again provide a high impedance capacitive path to the high frequency interference signals.

The problem with the capacitive approach is capacitors are subject to dielectric breakdown due to high signal strength of the interfering signals, environmental conditions, or aging of the dielectric. In addition, the connectors using capacitive filters are difficult and expensive to produce.

Other approaches for providing filtering for multipin connectors are shown in U.S. Pat. No. 3,487,353, Dec. 30, 1969, Massa, U.S. Pat. No. 3,727,169, Apr. 10, 1973, Crane et al, U.S. Pat. No. 3,868,162, Feb. 25, 1975, Ammon and U.S. Pat. No. 4,364,626, Dec. 21, 1982, Price.

The '353 patent teaches a multi-contact connector which includes a solid block of insulating material 37 (see FIG. 2). The patent does not identify the type of insulator material which is to be used.

The '169 patent teaches a multipin connector wherein the pins are embedded in the dielectric material (see FIG. 10) as mentioned at Column 4, lines 5 and 6, the '169 patent contemplates rigid plastic as the dielectric material.

The '162 patent teaches a D-type connector in association with a substrate 14 which comprises an insulative substrate with plated through holes. The '626 patent teaches a connector arrangement 10 including an insulative housing 12. The insulative housing has a plurality of through holes, and a separate wire passes through each of the through holes. Once again, the material of the insulator is not mentioned in the patent.

The '626 patent illustrates a further multipin connector.

SUMMARY OF INVENTION

It is therefore an object of the invention to provide a filtering means for a multipin connector.

It is a more specific object of the invention to provide a filtering means for a multipin connector comprising a ferrite material.

It is a further object of the invention to provide a multipin connector including filtering means.

It is a still further object of the invention to provide a multipin connector comprising a filtering means wherein said filtering means comprises a ferrite material.

In accordance with the invention, a ferrite plate is disposed in alignment with the insulator block of a D connector. The ferrite material provides a high impedance path to the high frequency signals.

The ferrite connector might also be connected to ground.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
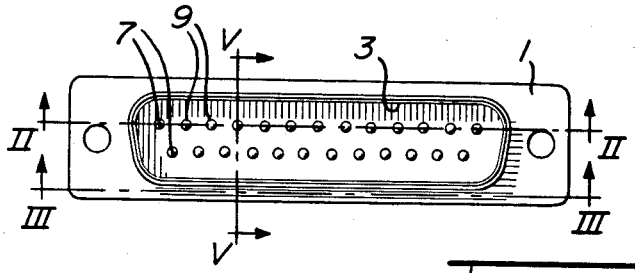
FIG. 1 is a front view of a connector in accordance with one embodiment of the invention.

A connector in accordance with the invention comprises a front shell 1 having a front opening 3 therein. An insulator 5 is disposed within the interior of the connector defined by the front and rear shells as will be described below. In a male connector, a plurality of pins 7 extend laterally of the connector towards the front opening 3 as is better illustrated in FIG. 5. The pins 7 extend through lateral openings 9 in the insulator. As can be seen, each pin 7 extends through a respective opening 9 of the insulator.

Figure 2:
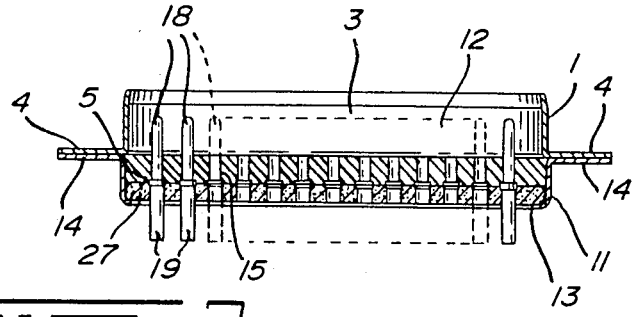
FIG. 2 is a section through II—II of FIG. 1.

The connector also includes an abutting rear shell 11 having a rear opening 13. The front and rear shells 1 and 11 form between them an inner space 12. As seen in FIG. 2, flanges 4 of the front shell abut with flanges 14 of the rear shell.

Figure 3:
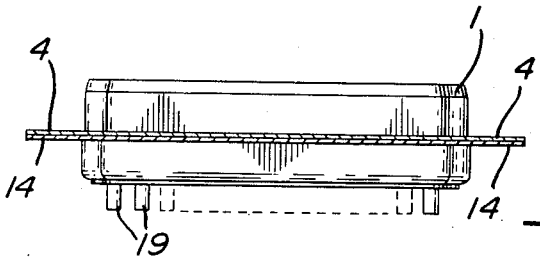
FIG. 3 is a section through III—III of FIG. 1.
Figure 4:
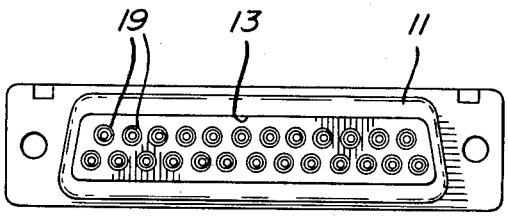
FIG. 4 is a rear view of the connector of FIG. 1.

Each pin 7 includes a plug-in portion 18 which extends into mating openings of female connector, and a soldering portion 19 to which are soldered leads of a circuit to be connected. As seen in FIGS. 2 and 3, the soldering portions extend through lateral openings 15 at the rear of the insulator plate.

Figure 5:
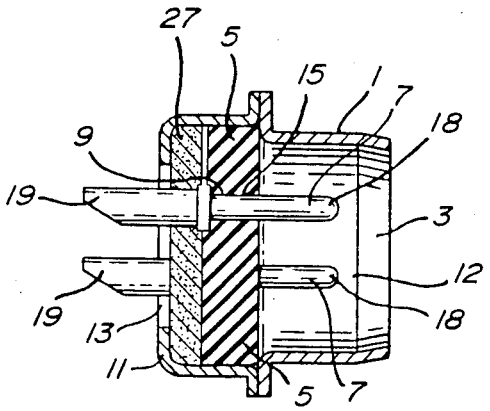
FIG. 5 is a section through V—V of FIG. 1.
Figure 7:
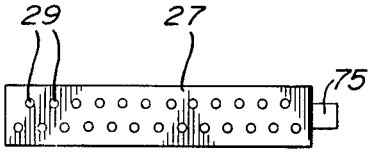
FIG. 7 illustrates a ferrite plate for a connector in accordance with the invention.

In accordance with the invention, a ferrite plate, such as the plate 27 illustrated in FIG. 7, is disposed in the inner space defined by the shells and aligned with the insulator block 5. The ferrite plate 27 includes lateral openings 29, and each lateral opening 29 is aligned with a respective lateral opening 9 or 15 of the insulator block. As can be seen in the drawings, the connecting pins are in physical contact with the ferrite block. The ferrite plate can be disposed on one side of the insulator block 5 as illustrated in FIGS. 2 and 5. In these figures, the ferrite plate is disposed at the rear of the insulator block, but it could just as easily be in front thereof.

Figure 6A:
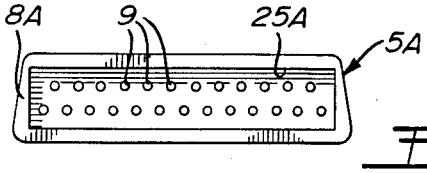
FIGS. 6A and 6B are mating views of a split insulator in accordance with the invention.
Figure 6B:
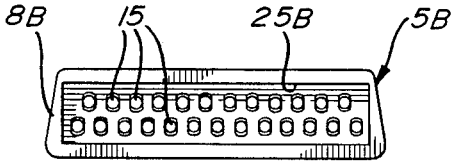
Figure 8:
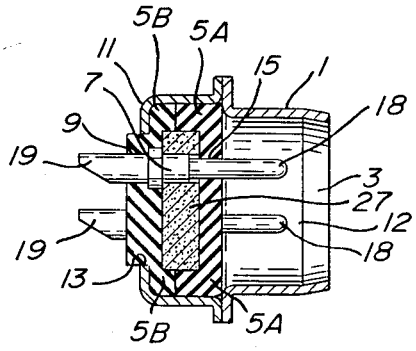
FIG. 8 is a view similar to FIG. 5 but modified in accordance with a second embodiment of the invention.

However, in accordance with a preferred embodiment of the invention, the insulator block is split in two to provide abutting portions 5A and 5B having abutting faces 8A and 8B in FIGS. 6A and 6B. A cavity 25A is machined into half of 5A and a cavity 25B is machined into half of 5B as also illustrated in FIGS. 6A and 6B. The ferrite plate 27 is then inserted in the cavity, and the insulator plates are brought together in abutting arrangement as illustrated in FIG. 8. This type of arrangement saves space relative to the arrangement as illustrated in FIG. 2.

Although the drawings illustrate the case wherein a cavity is machined into both of the insulator blocks, it would be obvious to have a deeper cavity in only one of the insulator blocks and the ferrite plate would be disposed in this one cavity. Alternatively, a cavity could be machined into the front face or the rear face of the insulator block, and the ferrite could then be disposed in this front face or rear face cavity.

Figure 9:
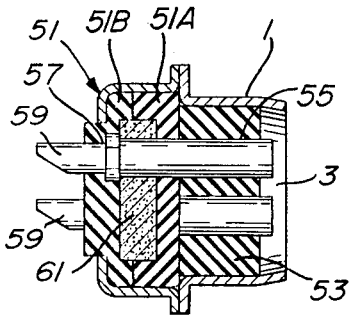
FIG. 9 is a view similar to FIG. 8 but illustrating a female connector modified in accordance with the invention.

A similar arrangement could be employed with a female connector as illustrated in FIG. 9. A female connector includes an insulator block 51 in the rear shell as well as an insulator block 53 in the front shell. Each opening 55 of the insulator block 53 is aligned with a respective opening 57 of the insulator block 51. Each opening 57 has associated with it a solder portion 59. In the embodiment illustrated in FIG. 9, a ferrite plate 61 is disposed in a split insulator block 51 (51A and 51B). Obviously, the ferrite plate could be disposed in a split insulator block 53. Or cavities could be machined in the facing surfaces of insulators 51 and 53 so that the ferrite plate would be disposed between the two insulators. Finally, cavities could be machined in the free faces of insulators 51 or 53 and the ferrite plate could be disposed in the free face cavities.

The composition of the ferrite plate is preferably a magnetic ceramic material consisting mainly of iron oxide blended with nickel and zinc oxides.

EMI and RFI Regulatory Organizations are concerned mainly with the frequency range from one megahertz to a thousand megahertz. The most radiated emissions generated by computers and peripherals occur at frequencies below 150 megahertz. The multi-hole ferrite plate of the invention has a resistivity volume in the order of $10^5$ ohm-cm. and exhibits optimum impedance characteristics from 30 megahertz to above 200 megahertz.

When a multi-hole ferrite plate, such as the plate 27, is inserted in a connector which passes D.C. and/or useful signals at other frequencies, as well as noise interference, the desired signals will pass through and the undesirable energy will be attenuated. This is accomplished through the impedance of the multi-hole ferrite plate which is frequency sensitive. D.C. and low frequency signals see only the conductor (the pins or connector openings) and are unimpeded. High frequency energy couples with the multi-hole ferrite plate and an impedance is developed which has inductive and resistive components at medium frequencies and becomes mostly resistive at high frequencies. At frequencies below 15 megahertz, most of the impedance is due to the inductive element so that attenuation occurs mostly due to reflection. As the frequency increases, the inductance diminishes and the resistive element dominates so that attenuation takes place through dissipation.

The ferrite plate 27 also includes a conductive tab 75 which is physically and electrically connected to the flanges 4 and 14. As the flanges 4 and 14 are at ground, the EMI and RFI signals will be filtered to ground by the ferrite plate providing the connector is grounded.

Although several embodiments have been described, this was for the purpose of illustrating, but not limiting, the invention. Various modifications, which will come readily to the mind of one skilled in the art, are within the scope of the invention as defined in the appended claims.

I claim:

1. A multipin connector comprising, a plurality of connector pins, a front shell having a front opening therein and an abutting rear shell having a rear opening therein, said front and rear shells defining between them an inner space;

and including:

a ferrite plate disposed in said inner space and in alignment with said front and rear openings, said ferrite plate being connected to a point of reference potential;

said ferrite plate comprising a plurality of lateral openings, each one of said connecting pins extending through a respective one of said lateral openings;

said connector pins being in physical contact with said ferrite plate.

2. A connector as defined in claim 1 and further including an insulator block disposed in said inner space in alignment with said front and rear openings;

whereby, said ferrite block is in alignment with said insulator block.

3. A connector as defined in claim 2 wherein said insulator block is split into two abutting parts, each abutting part having an abutting face;

a cavity defined in said insulator block between said abutting parts;

said ferrite plate being disposed in said cavity.

4. A connector as defined in claim 3 wherein a portion of said cavity is defined in one of said abutting faces and the remainder of said cavity is defined in the other one of said abutting faces.

5. In a multipin connector comprising, a plurality of connector pins, a front shell with a front opening therein, and an abutting rear shell with a rear opening therein, said front and rear shells defining between them an inner space;

an insulator block disposed in said inner space between said front and rear shells and having a plurality of lateral openings, each of said connector pins extending through a respective one of said lateral openings of said insulator block;

the improvement comprising:

a ferrite plate aligned with said insulator block and having a plurality of lateral openings, said ferrite plate being connected to a point of reference potential;

each of said lateral openings of said ferrite plate being aligned with a respective lateral opening of said insulator block;

whereby, each connector pin extends through both a respective opening in said insulator block and an aligned opening in said ferrite plate;

said connector pins being in physical contact with said ferrite plate.

6. A connector as defined in claim 5 wherein said insulator block is split into two abutting parts, each abutting part having an abutting face;

a cavity defined in said insulator block between said abutting parts;

said ferrite plate being disposed in said cavity.

7. A connector as defined in claim 6 wherein a portion of said cavity is defined in one of said abut ting faces and the remainder of said cavity is defined in the other one of said abutting faces.

* * * * *